US012376659B2

(12) United States Patent
Li

(10) Patent No.: US 12,376,659 B2
(45) Date of Patent: Aug. 5, 2025

(54) CONVENIENT HAIR DRYER

(71) Applicant: Zhaoqing Heng Yi Industrial Company Limited, Zhaoqing (CN)

(72) Inventor: Manli Li, Shenzhen (CN)

(73) Assignee: Heng Yi Technology Company Limited, Zhaoqing (CN)

( * ) Notice: Subject to any disclaimer, the term of this patent is extended or adjusted under 35 U.S.C. 154(b) by 787 days.

(21) Appl. No.: 17/632,501

(22) PCT Filed: Aug. 22, 2019

(86) PCT No.: PCT/CN2019/101935

§ 371 (c)(1),
(2) Date: Feb. 2, 2022

(87) PCT Pub. No.: WO2021/026956

PCT Pub. Date: Feb. 18, 2021

(65) Prior Publication Data

US 2022/0279911 A1 Sep. 8, 2022

(30) Foreign Application Priority Data

Aug. 12, 2019 (WO) ..... PCT/CN2019/100166

(51) Int. Cl.
*A45D 20/12* (2006.01)

(52) U.S. Cl.
CPC ..... *A45D 20/12* (2013.01); *A45D 2020/128* (2013.01)

(58) Field of Classification Search
None
See application file for complete search history.

(56) References Cited

U.S. PATENT DOCUMENTS 2,579,348 A * 12/1951 Taylor ..... F16M 11/08 108/4
8,151,481 B2 4/2012 Perez, Jr.
2010/0170104 A1* 7/2010 Shami ..... A45D 20/12 34/283

FOREIGN PATENT DOCUMENTS

CN 2358743 Y 1/2000
CN 203087949 U 7/2013
CN 104643513 A 5/2015
CN 205757892 U 12/2016
CN 205829755 U * 12/2016
(Continued)

OTHER PUBLICATIONS

Notice of Reasons for Refusal for Japanese Patent Application No. 2022-507382; issued Mar. 29, 2023.
(Continued)

*Primary Examiner* — Jason Lau
(74) *Attorney, Agent, or Firm* — Flener IP & Business Law; Zareefa B. Flener

(57) ABSTRACT

Disclosed is a convenient hair dryer, comprising a body and a holder connected thereto, wherein the holder is configured to be reversibly and fast convertible between a handle configuration and a support configuration. The present disclosure may conveniently achieve the switching of the hair dryer between a hand-held operation mode and a hands-free operation mode, and make the use of the hair dryer more flexible and convenient. In addition, the holder achieves fast and flexible adjustment of the air blowing angle, air blowing direction and air blowing height with simple structures.

7 Claims, 7 Drawing Sheets

(56) References Cited

FOREIGN PATENT DOCUMENTS

| | | | | |
|---|---|---|---|---|
| CN | 107744238 | A | | 3/2018 |
| CN | 108378517 | A | | 8/2018 |
| CN | 208080767 | U | | 11/2018 |
| JP | S55177304 | U | | 12/1980 |
| JP | H03168103 | A | | 7/1991 |
| JP | H08112134 | A | | 5/1996 |
| JP | 2003116625 | A | * | 4/2003 |
| JP | 31566126 | U | | 12/2009 |

OTHER PUBLICATIONS

International Search Report and Written Opinion, PCT/CN2019/101935, Date of mailing Apr. 24, 2020.

* cited by examiner

CONVENIENT HAIR DRYER

The present application claims priority of PCT/CN2019/100166 filed on Aug. 12, 2019 before the Chinese Receiving Office and entitled as "Convenient Hair Dryer".

FIELD OF THE DISCLOSURE

The present disclosure relates to a hair dryer especially for drying hair.

BACKGROUND OF THE DISCLOSURE

At present, most hair dryers for drying hair available in the market need to be hand-held for the drying operation, which is very inconvenient on many occasions such as drying long hair, and is liable to cause fatigue.

CN104783472A discloses a strong magnetic attraction type automatic head-oscillatable hair dryer. CN203087949U discloses a rotary hair dryer. CN208581919U discloses a hair dryer bracket with an oscillation function. CN104621944A discloses a suction cup type safety hair dryer. Although the above-mentioned hair dryer devices can realize the hands-free operation and the adjustment of the air-blowing direction by providing a separate or integrated modified bracket, they are complicated in structure and inconvenient in use and carrying, and particularly they cannot address the problem about convenient switching of a hand-held operation mode and a hands-free operation mode at any time and at any place.

SUMMARY OF THE DISCLOSURE

An object of the present disclosure is to provide a hair dryer which is capable of conveniently achieving switch between a hand-held operation mode and a hands-free operation mode.

According to the present disclosure, there is provided a hair dryer which comprises a body and a holder or holding mechanism connected thereto, wherein the holder is configured to be reversibly convertible from a handle configuration to a support configuration via its own metamorphosis in shape. This fast conversion idea enables convenient switching of the hair dryer between a hand-held operation mode and a hands-free operation mode.

In the present disclosure, "metamorphosis in shape of the holder on its own" means the shape change or transformation of the holder by itself, and does not include the following case: the holder does not substantively change in the structure and shape, and only changes in position relative to the body of the hair dryer, for example, in pivotal positions.

According to a specific implementation of the present disclosure, the holder has a connecting end connected to the body and an opposite free end (non-connecting end). The free end of the holder is configured to be expandable in shape so as to enlarge its support footprint(s). With the free end being expanded, the holder may quickly switch or transform from an initial handle to a fixing support, and thus the hair dryer being conveniently switched to perform the hands-free air blowing operation.

According to an embodiment of the present disclosure, the holder may include more than one wing (preferably 2-4 wings, for example three wings) encircling its free end so that the holder acts as the handle when the wings do not flare out and acts as the support when the wings flare out. Such a holder is structurally simple and can very conveniently achieve the air blowing mode switch or transformation.

Although other variations may be employed, for example, a fixing seat or fixing disc may be fast connected to (e.g., plugged into) the free end of the holder, or even an expandable supporting disc or support webs may be ejected or pulled out of the free end, use of the "open-umbrella" variation or modification of the present disclosure is obviously more advantageous in structural integration or convenience in use. In addition, in the "open-umbrella" embodiment of the present disclosure, the distal ends (flarable ends) of the wings may be disposed at the free end of the holder and flare outwardly 0-90° therefrom ("forwardly open" mode); or the proximal ends (connecting and fixing ends) of the wings may be disposed at the free end of the holder so that the distal ends of the wings may flare outwardly or flip 90-180° towards the free end of the holder ("reversely open" mode). As compared with the "reversely open" mode structure, the "forwardly open" mode structure is simpler and more convenient to operate; however, the "reversely open" mode structure may enable the holder to extend longer or higher (within a range approximate to the length of the wings) so as to adjust the air blowing height.

In addition, the body of the hair dryer may be integrally formed with a hollow handle in a way that the holder of the present disclosure may be received in the hollow handle and be pulled and ejected out of the hollow handle. The transformation of the holder to the handle may be implemented by receiving the holder in the hollow handle; the transformation from the handle to the fixing support may be implemented by pulling the holder out of the hollow handle and making its free end expand.

According to a further preferred embodiment of the present disclosure, when the holder flares out and acts as a support, the distal ends of the wings may substantially be in the same supporting surface (horizon) as the free end of the holder. Such a structure makes the support firmer.

In addition, the free end of the holder may be provided with a suction cup or friction pad. The free ends of the wings may also be provided with a friction pad respectively. Such a structure may further enhance the support stability.

According to a further preferred embodiment of the present disclosure, the holder is telescopic in its longitudinal direction, for example, the holder is configured as a telescopic sleeve or a multi-stage antenna structure. Such a configuration may enable convenient adjustment of the air blowing height. The telescopic sleeve may be designed to be adjusted in its telescopic length and be retained or fixed at any length position; or may be designed as a multi-stage positioning sleeve so that it can be retained or fixed at different set length positions.

According to the hair dryer of the present disclosure, the holder is preferably movably connected to the body of the hair dryer. The movable connection manner facilitates adjustment of the air blowing angle and air blowing direction. In the text herein, the body of the hair dryer is relative to the holder and comprises a housing, parts located in the housing and various stationary accessories disposed on the housing.

The above movable connection may either be a separable or detachable connection or an inseparable or undetachable connection.

According to an embodiment of the inseparable and movable connection, the holder may be connected to the body of the hair dryer via a hinge. The pivotal connection manner not only enables the holder to conveniently adjust the air blowing angle when the holder is used as the support, but also enables the holder to be folded towards the body for purpose of convenient carrying or enables the holder to be received at a proper position of the body to facilitate storage. The hinge may be such a hinge that can be positioned at any pivot angle, i.e., can be arbitrarily pivoted and stay or be fixed at a current pivot position. Alternatively, the hinge may be a multi-stage positioning hinge that can be pivoted and positioned at different set angles.

The hinge may be further fixed to a rotatable shaft disposed on the holder. Such a structure may cater to adjustment of the air blowing angle as well as the air blowing direction. The rotatable shaft may be rotated to stay or be fixed at an arbitrary current orientation; or may be fixed at different set orientations.

According to an embodiment of the separable and movable connection, the holder may be connected to the body of the hair dryer via a magnetic coupling. In this case, the coupling consists of an iron ball disposed on one of the body and the holder and a socket including a ring magnet disposed on the other of the body and the holder for magnetically receiving the iron ball therein. Such a movable connection is simpler in structure, not only enables adjustment of the air blowing angle and air blowing direction when the holder is used as a support, but also facilitate fast separation of the holder from the body of the hair dryer, and facilitates the carrying and storage.

Certainly, the magnetic coupling is not limited to a specific combined structure of the iron ball and the ring magnet, and any suitable magnetic coupling connection is feasible: for example, a ferromagnetic member-magnet combination or a magnet-magnet combination.

According to another embodiment of the inseparable and movable connection, the holder may also be connected to the body of the hair dryer via a freely-deformable rope (flexible rope). Such structure may also achieve multi adjustments of the air blowing angle, air blowing direction and air blowing height.

According to a further embodiment of the inseparable and movable connection, the holder may be connected to the body of the hair dryer via a friction ball mechanism. The friction ball mechanism may comprise a receptacle, a rotatable ball and a friction pad, and the ball is undetachably received in the receptacle under a tight fit through the friction pad encircling the ball (the holder, under action of an external force against the friction force, can rotate in any direction and stay at a current position when the external force is removed). In this case, the receptacle may be disposed on one of the body and the holder, and the ball may be connected to the other of the body and the holder via a connecting rod.

In the case of a movable connection of the holder to the body, the holder may be retracted towards the body of the hair dryer so that the whole hair dryer, not in use, can have a single consistent tube configuration such as a cylinder, an elliptical cylinder, a spindle-shaped tube or a rectangular tube.

In the case of inseparable connection, at least one portion of the body may have an incomplete tube section. When the holder is completely retracted (also contracted to an initial shape with a minimum volume) towards the body, the section of the holder is complementary with said incomplete tube section of said at least one portion of the body so as to form a substantially complete tube section.

Furthermore, the body may include in linear a front operational tube part with a complete tube section and a rear tube part with an incomplete tube section, the front operational tube part is configured to perform a blowing operation and has an air inlet formed at its rear end, the rear tube part has an air air-incoming chamber formed therein and also designed to receive a power supply line for powering the front operational tube part, the air-incoming chamber is in air communication with the air inlet of the front operational tube part, and the holder section is complementary with the incomplete tube section of the rear tube part so as to form a substantially complete tube section corresponding to the complete tube section of the front operational tube part when the holder is completely contracted and retracted towards the rear tube part.

In the case of separable or detachable connection, the body may include in linear a front operational tube part and a rear tube part, the front operational tube part is configured to perform a blowing operation and has an air inlet formed at its rear end, the rear tube part has an air-incoming chamber formed therein and also designed to receive a power supply line for powering the front operational tube part, the air-incoming chamber is in air communication with the air inlet of the front operational tube part, the front operational tube part has a section which is substantially consistent with that of the rear tube part, and wherein the rear tube part is further designed to receive the detached holder therein. In addition, the rear tube part may be removably or detachably connected to the front operational tube part, such that the hair dryer becomes light and handy when in use by removal of the rear tube part.

Such a single tube configuration makes the hair dryer of the present disclosure look very brief, neat and beautiful when in a not-in-use state, for example, when the hair dryer is stored, minimizes the occupied space and eliminates the trouble caused by the messy power supply line.

In addition, the hair dryer of the present disclosure may further comprise a cover which is used to at least cover a rear end of the rear tube part when the power supply line is received in a chamber of the rear tube part.

According to a preferred embodiment of the present disclosure, the holder may be connected to a side of the body of the hair dryer. The side connection or lateral connection may enable the holder to be connected to around a center of gravity of the body of the hair dryer so as to facilitate operation and use. Certainly, the holder may be connected at other positions, for example, at a position nearby an end opposite to the air outlet in a longitudinal direction of the body of the hair dryer.

As a variation, a magnet may be attached to the free end of the holder or the free end of the holder may be designed as a clip to facilitate flexible fixation and use of the hair dryer on different occasions.

According to the hair dryer of the present disclosure, it is possible to conveniently enable the holder to switch between the handle configuration for the hand-held mode and the support configuration for the hands-free mode, thereby making the its use more flexible and convenient. In addition, the holder achieves fast and flexible adjustment of the air blowing angle, air blowing direction and air blowing height by means of simple structures.

DETAILED DESCRIPTION OF PREFERRED EMBODIMENTS

The present disclosure will be described in detail below with reference to the figures. Those skilled in the art should understand that the following example embodiments are only used to illustrate, not limit the present disclosure.

Figure 1:
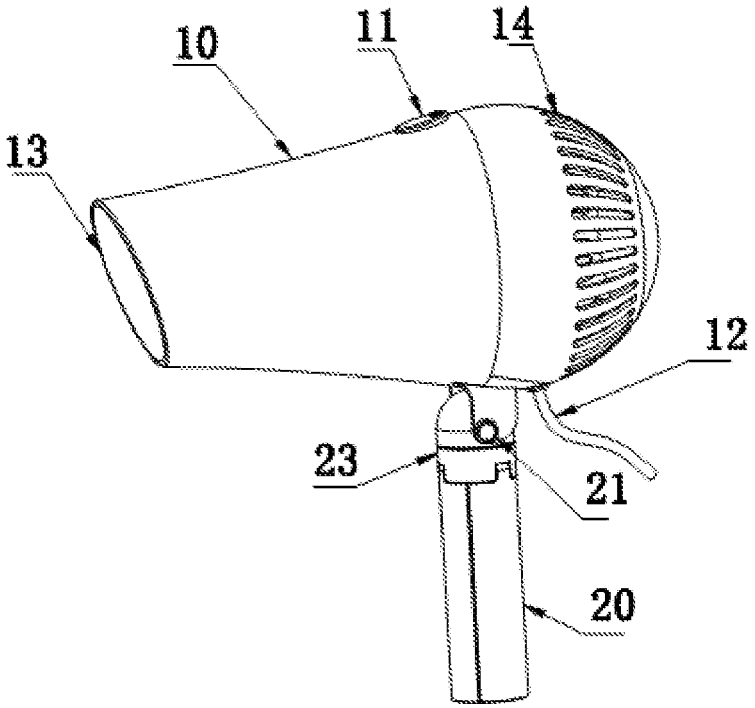
FIGS. 1-3 respectively illustrate a hair dryer according to a first embodiment of the present disclosure.
Figure 2:
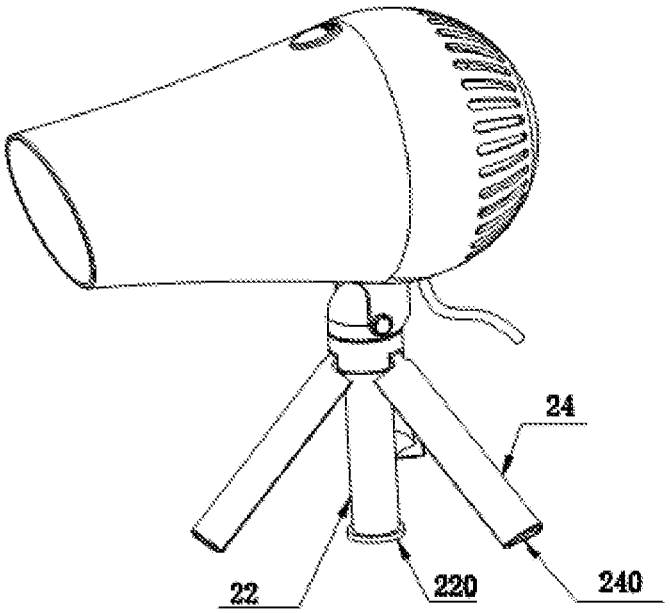
Figure 3:
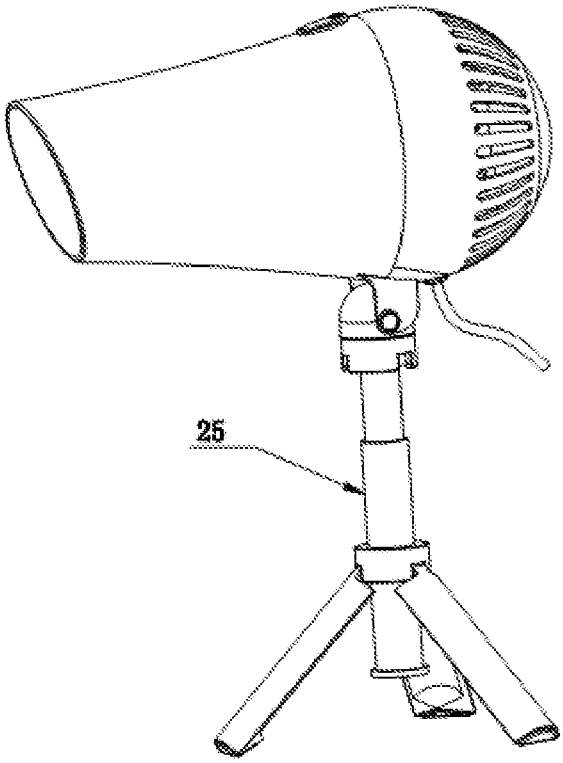

FIGS. 1-3 respectively illustrate a hair dryer according to a first embodiment of the present disclosure, generally including a body 10 and a holder 20 connected thereto. The body 10 is provided with a switch 11, an external power supply line 12, an air outlet 13, an air inlet 14, a heating element and a motor (not specifically shown), and the like.

FIG. 1 shows a schematic view of a hand-held state of the hair dryer according to the first embodiment, wherein the holder 20 is contracted or folded into a rod shape to facilitate the gripping operation by a hand.

FIG. 2 shows a schematic view of a hands-free state of the hair dryer according to the first embodiment, wherein the holder 20 is unfolded or flared out as a fixing support so that the hair dray is fixed on a table surface for hands-free blowing operation.

FIG. 3 shows a schematic view of a hands-free state of the hair dryer according to the first embodiment, wherein the holder 20 is unfolded or flared out as a fixing support as shown in FIG. 2, and additionally extends in its longitudinal direction to raise the air blowing position.

As shown in FIGS. 1-3, the holder 20 is connected to a side of the body 10 via a hinge 21, pivotable in a vertical plane (illustrated paper surface). The hinge 21 may be such a hinge that can be positioned at any pivot angle, i.e., the hinge can be arbitrarily manually pivoted and stay at a current pivot position. Alternatively, the hinge 21 may be a multi-stage positioning hinge that can be manually pivoted and positioned at different set angles. The holder 20 includes a shaft 22, a hinge seat 23 at an upper end (a connecting end) of the shaft, and three flarable wings 24 located at a lower portion of the shaft. Distal ends of the wings 24 form support legs, and proximal ends of the wings 24 are connected to the shaft 22. When the wings 24 flare, the distal ends thereof may also flush with a lower end of the shaft 22 in the same plane to facilitate firm support on an appropriate table surface. For stable support on the table surface, the distal ends of the wings 24 are provided with friction pads 240, and the lower end of the shaft 22 is also provided with a suction cup or friction pad 220, as shown in FIGS. 2 and 3. The air blowing angle (an angle between the air blowing direction and the shaft 22) can be adjusted very conveniently by the above pivotal connection. In addition, the hinge seat 23 is rotatably mounted relative to the shaft 22 to facilitate adjusting of the air blowing direction. The hinge seat 23 may be manually rotated relative to the shaft 22 and stay or be fixed at any current orientation, or may be fixed at different set orientations.

In an "open-umbrella" embodiment shown in FIGS. 1-3, the distal ends or flarable ends of the wings are disposed at a free end (lower end of the shaft 22) of the holder 20 and can flare outwardly 0-90° therefrom ("forwardly open" mode). However, it is also possible to dispose the proximal ends or connecting and fixing ends of the wings 24 at the free end of the holder 20 so that the distal ends of the wings 24 can flare outwardly 90-180° towards the free end of the holder 20 ("reversely open" mode). As compared with the "reversely open" mode structure, the "forwardly open" mode structure is simpler and more convenient to operate; however, the "reversely open" mode structure can enable the holder to extend longer or higher (within a range approximate to the length of the wings) so that adjustment of the air blowing height can still be conveniently achieved in a case that a telescopic sleeve described below is dispensed with.

As clearly shown in FIG. 3, a body portion of the shaft 22 is formed by a multi-stage (e.g., two to five stages) telescopic sleeve 25 so that the shaft 22 can be extended or retracted to adjust the air blowing height. The telescopic sleeve 25 may be designed in a way that the telescopic length thereof can be manually adjusted and retained or fixed at any length position. Alternatively, the telescopic sleeve 25 may be designed as a multi-stage positioning sleeve so that it can stay or be fixed at set length positions.

Figure 4:
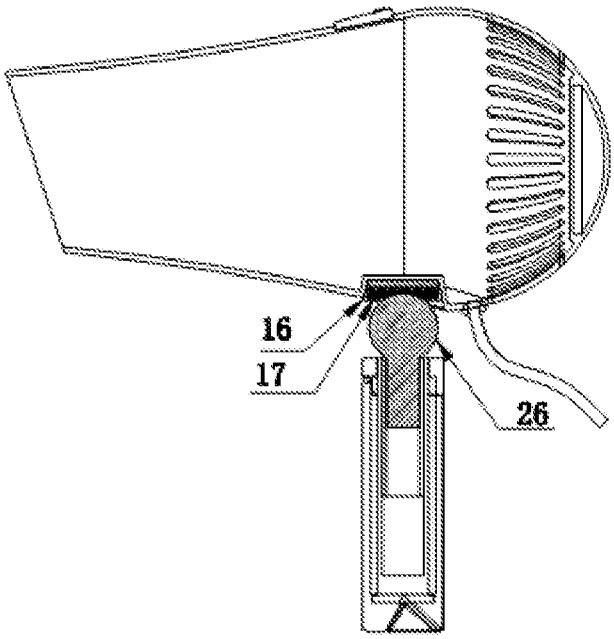
FIGS. 4-6 respectively illustrate a hair dryer according to a second embodiment of the present disclosure.
Figure 5:
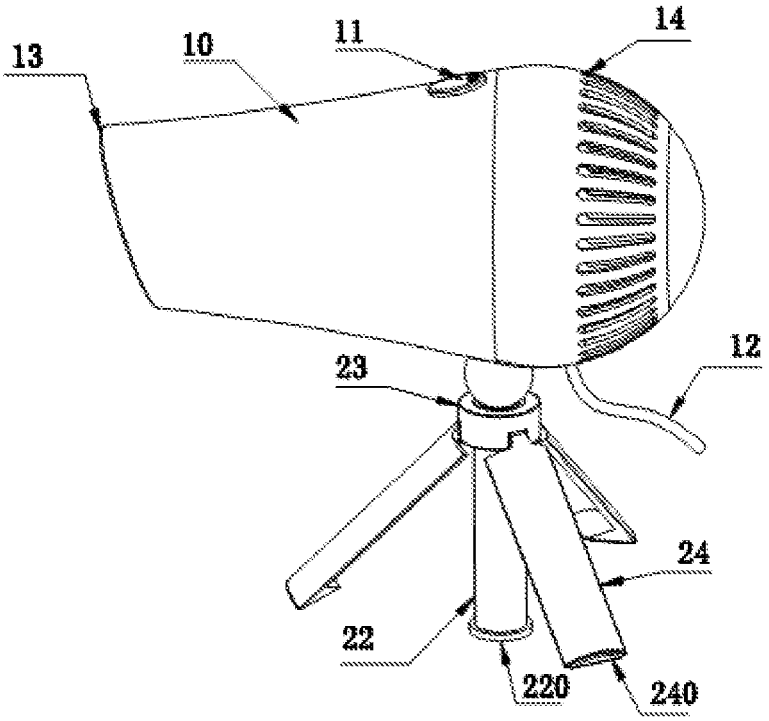
Figure 6:
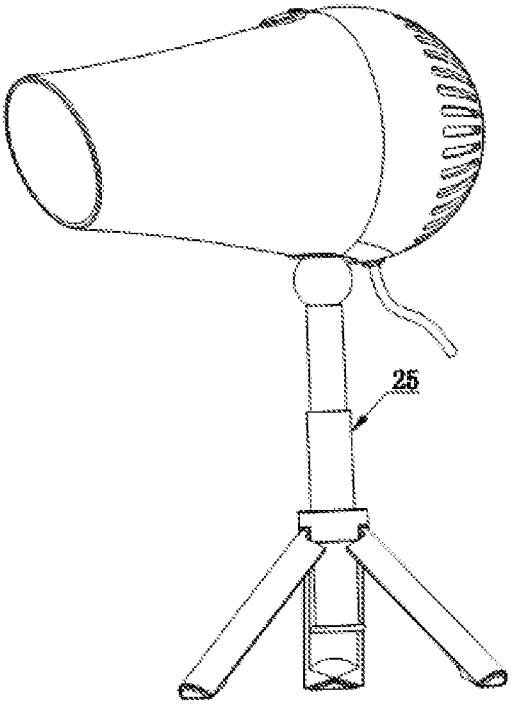

FIGS. 4-6 respectively illustrate a hair dryer according to a second embodiment of the present disclosure, which is generally similar to the embodiment shown in FIGS. 1-3, wherein the holder in FIG. 4 is shown in a sectional manner with the same reference numbers denoting the same parts; the difference lies in that the holder 20 in this embodiment is connected to the body of the hair dryer via a magnetic coupling, in place of the rotatable hinge seat structure in the first embodiment. As more clearly shown in FIG. 4, the magnetic coupling comprises a socket 16 disposed on the body 10 and an iron ball disposed in the holder 20, wherein a ring magnet 17 is disposed in the socket 16. The iron ball 26 and the magnet 17 in the socket 16 mate with each other by attraction, such that the holder 20 can rotate arbitrarily and be fast detachably connected to the body 10 of the hair dryer.

Figure 7:
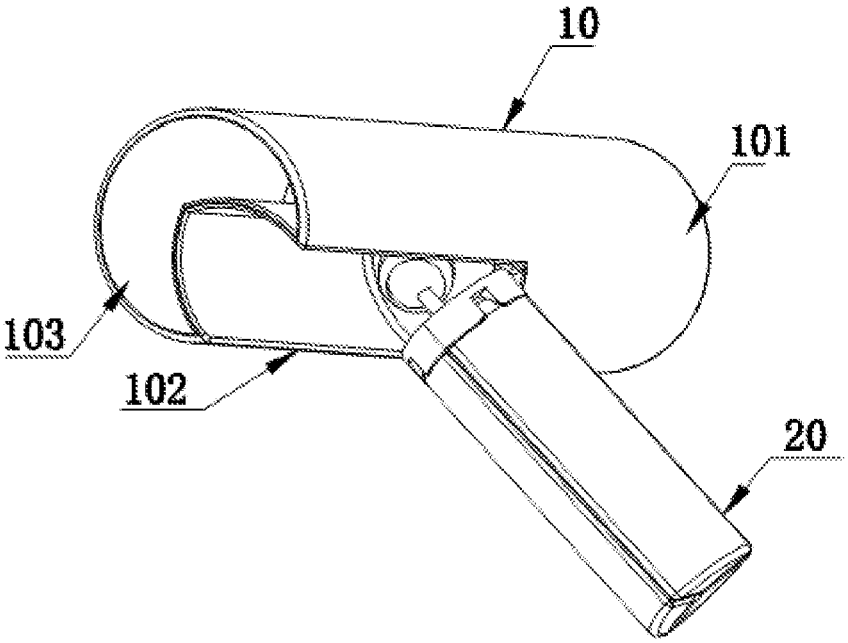
FIGS. 7-8 illustrate a hair dryer according to a third embodiment of the present disclosure.
Figure 8:
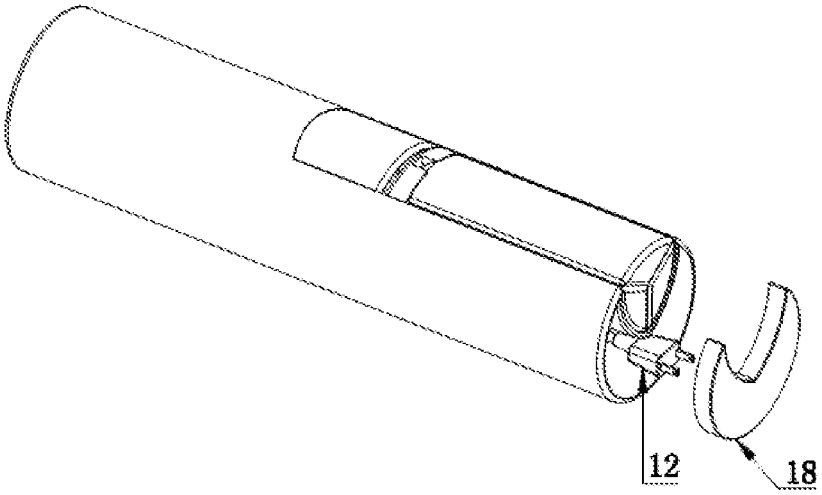

FIGS. 7-8 illustrate a hair dryer according to a third embodiment of the present disclosure. The configuration of the present embodiment is also different from that of the second embodiment, besides a different movable connection of the holder 20 with the body 10. FIG. 7 shows a state in which the holder 20 extends out of the body 10 of the hair dryer 10. It can be seen that the holder 20 is connected to the body 10 of the hair dryer via a friction ball mechanism. In addition, as shown in FIG. 8, in a retracted state, the body 10 and the holder 20 as a whole form a continuous cylinder shape.

Figure 9:
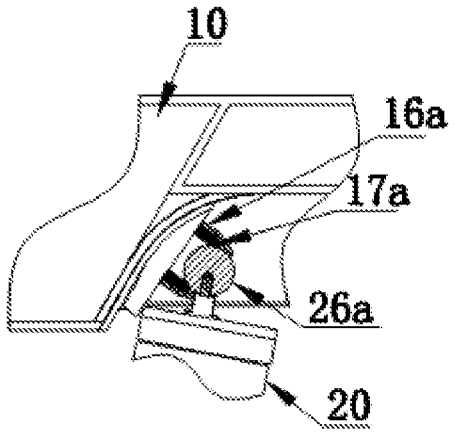
FIG. 9 illustrates a partially enlarged schematic view of a friction ball mechanism of the hair dryer according to the third embodiment of the present disclosure.

As more clearly shown in FIG. 9, the friction ball mechanism comprises a receptacle **16*a* disposed on the body 10, and a metal rotatable ball 26*a* disposed at an upper end of the holder 20. The rotatable ball 26*a* may be connected together with the holder 20 via a threaded structure. A friction pad 17*a* is disposed in the receptacle 16*a*. Through tight fitting of the rotatable ball 26*a* and the friction pad 17*a* in the receptacle 16*a*, the holder 20, under action of an external force against the friction force, can rotate in any direction and stay at a current position when the external force is removed. The receptacle 16*a* and the rotatable ball 26*a* are sized in a way that the rotatable ball 26*a* can only rotate in the receptacle 16*a* without disengaging from the receptacle 16*a***.

As shown in FIG. 8, the body 10 of the hair dryer includes in linear a front operational tube part 101 and a rear tube part 102, wherein the front operational tube part 101 is configured to perform a blowing operation and has an air inlet (not shown) formed at its rear end, and the rear tube part has an air-incoming chamber 103 formed therein for receiving a power supply line 12 for powering the front operational tube part 101. The air-incoming chamber is in air communication with the air inlet of the front operational tube part 101. The front operational tube part 101 has a complete cylindrical section, and the rear tube part 102 has an incomplete cylindrical section (a sector) relative to the front operational tube part 101. The section of the holder 20 is complementary with the cylindrical section of the rear tube part 102 so as to form a substantially complete cylindrical section (a circular section) corresponding to that of the front operational tube part 101 when the holder 20 is completely contracted and retracted towards the rear tube part 102.

FIG. 8 further shows a cover 18. After the power supply line 12 is received in the chamber 103 of the rear tube part 102, the cover 18 is used to cover a rear end of the rear tube part 102. Certainly, the cover 18 may also be designed to completely cover the rear end of the hair dryer.

Figure 10:
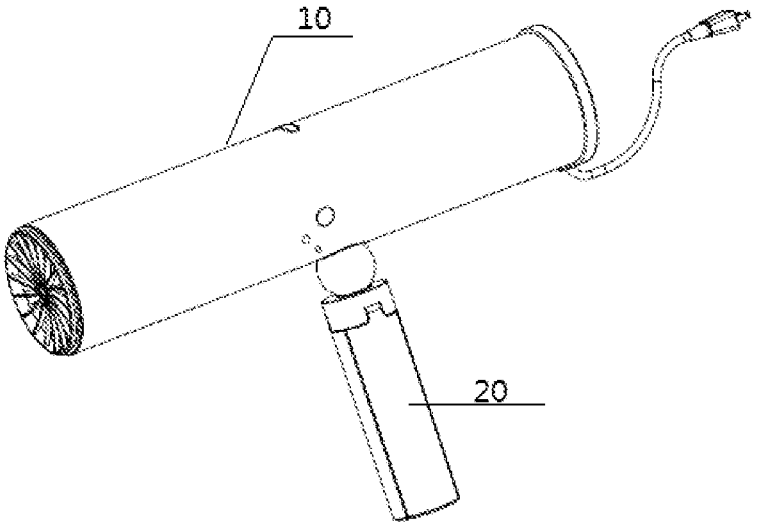
FIGS. 10-12 illustrate a hair dryer according to a fourth embodiment of the present disclosure.
Figure 11:
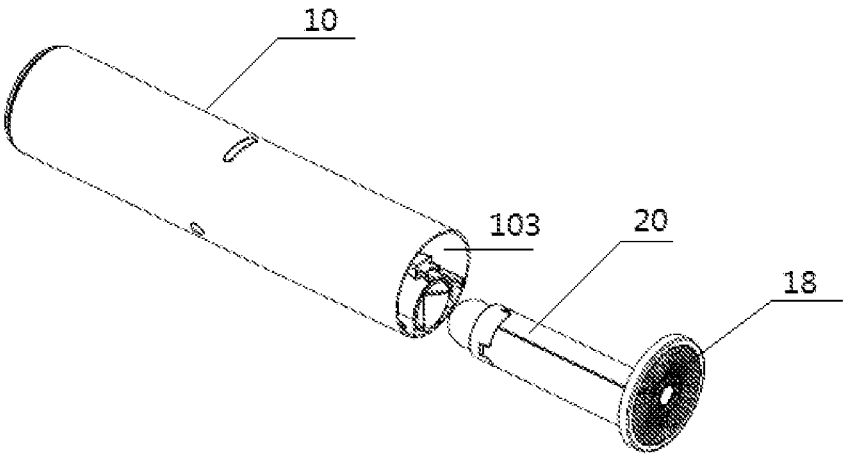
Figure 12:
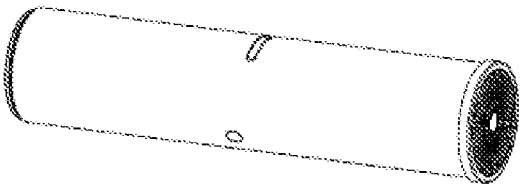

FIGS. 10-12 illustrate a hair dryer according to a fourth embodiment of the present disclosure. In this embodiment, the connection between the holder 20 and the body 10 is a separable or detachable connection in the form of a magnetic coupling of the second embodiment as shown in FIGS. 4-6. In addition, the whole hair dryer of this embodiment looks like a perfect cylinder when the detached holder 20, like the power supply line, is received in the chamber 103 of the body 10 and covered by the cover 18 (FIGS. 11 and 12).

Figure 13:
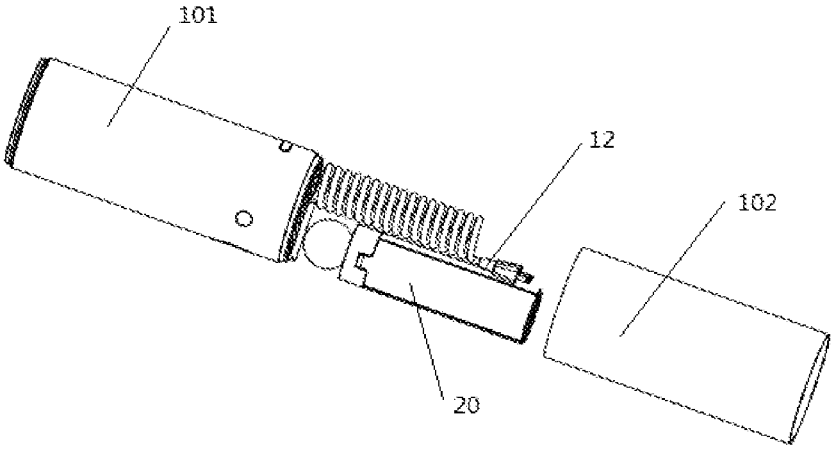
FIG. 13 illustrates a hair dryer according to a fifth embodiment of the present disclosure.

FIG. 13 illustrates a hair dryer according to a fifth embodiment of the present disclosure. The hair dryer in the present embodiment is similar to that of the fourth embodiment in structure and different in that the front operational tube part 101 is not integrally formed with the rear tube part 102 but connected thereto detachably or removably by means of screw or snap-fit connection. Such a configuration can bring such an advantage: the hair dryer will become light and handy when in use by removal of the rear tube part 102.

Figure 14:
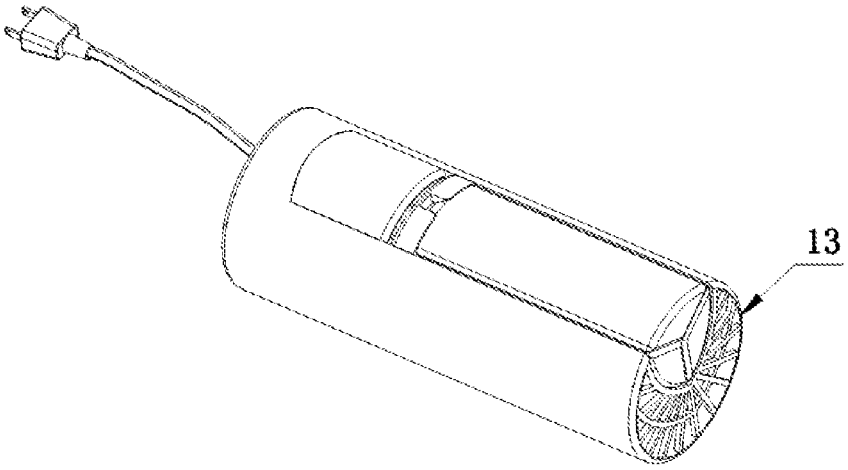
FIG. 14 illustrates a hair dryer according to a sixth embodiment of the present disclosure.

FIG. 14 illustrates a hair dryer according to a sixth embodiment of the present disclosure. The hair dryer in the present embodiment is similar to that of the third or fourth embodiment in structure and different in omitting the rear tube part 102 (thereby making the whole hair dryer shorter), and meanwhile enabling the holder 20 to flip forward (towards the air outlet 13) relative to the body 10 and enabling the whole hair dryer to form a single continuous cylindrical configuration.

Those skilled in the art should appreciate that features of the above embodiments may be combined mutually, for example, the hair dryers of the first and second embodiment may also employ the single cylindrical configuration of the third or fourth or fifth or sixth embodiment.

What is claimed is:

1. A hair dryer, comprising a body and a holder connected thereto, wherein the holder is configured to be convertible between a handle configuration and a support configuration via its own metamorphosis in shape, the holder is detachably connected to the body via a magnetic coupling, the body includes in linear a front operational tube part and a rear tube part which is detachably connected to the front operational tube part such that the hair dryer will become light and handy when in use by removal of the rear tube part, the front operational tube part is configured to perform a blowing operation and has an air inlet formed at its rear end, the rear tube part has an air-incoming chamber formed therein and also designed to receive a power supply line for powering the front operational tube part, the air-incoming chamber is in air communication with the air inlet of the front operational tube part, the front operational tube part has a section which is substantially consistent with that of the rear tube part, and the rear tube part is further designed to receive the detached holder completely therewithin.

2. The hair dryer of claim 1, wherein the holder has an end connected to the body and an opposite free end which is configured to be expandable so as to enlarge its support footprint(s).

3. The hair dryer of claim 2, wherein the holder includes at least one wing encircling its free end so that the holder acts as the handle when the wings do not flare out and acts as the support when the wings flare out.

4. The hair dryer of claim 3, wherein distal ends of the at least one wing are disposed with a friction pad respectively.

5. The hair dryer of claim 1, wherein the holder is telescopic in its longitudinal direction.

6. The hair dryer of claim 1, wherein the coupling consists of an iron ball disposed on one of the body and the holder and a socket including a ring magnet disposed on the other of the body and the holder for magnetically receiving the iron ball therein.

7. The hair dryer of claim 1, wherein said single tube configuration is a cylinder configuration.

* * * * *